US012638174B2

(12) United States Patent
Bhayaraju et al.

(10) Patent No.: US 12,638,174 B2
(45) Date of Patent: May 26, 2026

(54) FUEL-AIR MIXING AND FLAME STABILIZATION DEVICE FOR A LOW EMISSION BURNER WITH INTERNAL FLUE GAS RECIRCULATION

(71) Applicant: Honeywell International Inc., Charlotte, NC (US)

(72) Inventors: Umesh Chandra Bhayaraju, Carmel, IN (US); Curtis Lynn Taylor, Paradise Valley, AZ (US); Bradley Dean Patterson, Dunkirk, IN (US); Ross Halstead, Mooreland, IN (US)

(73) Assignee: Honeywell International Inc., Charlotte, NC (US)

( * ) Notice: Subject to any disclaimer, the term of this patent is extended or adjusted under 35 U.S.C. 154(b) by 892 days.

(21) Appl. No.: 17/954,580

(22) Filed: Sep. 28, 2022

(65) Prior Publication Data

US 2024/0102649 A1 Mar. 28, 2024

(51) Int. Cl.

| | |
|---|---|
| ***F23D 14/64*** | (2006.01) |
| ***F23C 9/00*** | (2006.01) |
| ***F23D 14/84*** | (2006.01) |

(52) U.S. Cl.

CPC ..... *F23D 14/64* (2013.01); *F23C 9/006* (2013.01); *F23D 14/84* (2013.01); *F23C 2202/30* (2013.01); *F23D 2203/101* (2013.01)

(58) Field of Classification Search

CPC ..... F23D 14/64; F23D 14/84; F23D 11/002; F23C 9/006; F23C 2202/30

USPC ..... 431/354, 188, 8, 353, 9, 174, 176, 178, 431/115–116

See application file for complete search history.

(56) References Cited

U.S. PATENT DOCUMENTS

| | | | | |
|---|---|---|---|---|
| 5,338,186 | A * | 8/1994 | Sulzhik | F23D 14/125 431/348 |
| 5,460,512 | A * | 10/1995 | Lifshits | F23D 14/46 431/9 |
| 6,652,268 | B1 * | 11/2003 | Irwin | F23D 14/24 431/115 |
| 10,451,271 | B2 | 10/2019 | Taylor et al. | |
| 10,533,741 | B2 | 1/2020 | Taylor et al. | |
| 2021/0254860 | A1 | 8/2021 | O'Donnell et al. | |
| 2022/0163197 | A1 | 5/2022 | Taylor et al. | |

OTHER PUBLICATIONS

"LO-NOx burner", wikipedia, retrieved from "https://en.wikipedia.org/w/index.php?title=LO-NOx_burner&oldid=1058075240"; page last edited on Dec. 1, 2021.

(Continued)

*Primary Examiner* — Vivek K Shirsat

(74) *Attorney, Agent, or Firm* — Ingrassia Fisher & Lorenz LLP

(57) ABSTRACT

A flame stabilization apparatus with fuel injection upstream of a torpedo, includes a flame stabilization plate that incorporates spokes that stabilize a flame over a range of operations of a burner. The spokes surround a fuel plenum with respect to the burner. A first group of fuel ports can be located in a fuel tube upstream of the torpedo and a second group of fuel ports can be located in the flame stabilization plate. A discharge cone includes a discharge zone for the burner, wherein the flame with respect to the flue gas is stabilized at an end of the burner in the discharge zone.

20 Claims, 4 Drawing Sheets

(56) References Cited

OTHER PUBLICATIONS

"Ultra Low NOx Burner: Everything You Should Know", Jun. 12, 2019; Ruichang, https://burnertec.com/ultra-low-nox-burner-everything-you-should-know/.
"The best natural gas burners in the world are developed using CFD modeling," Nov. 18, 2020, Olion.
Colorado Andres, "Pollutant Emissions and Lean Blowoff Limits of Fuel Flexible Burners Operating on Gaseous Renewable and Fossil Fuels," 2016, UC Irvine Electronic Theses and Dissertations, https://escholarship.org/uc/item/2488h7t1.

* cited by examiner

FUEL-AIR MIXING AND FLAME STABILIZATION DEVICE FOR A LOW EMISSION BURNER WITH INTERNAL FLUE GAS RECIRCULATION

TECHNICAL FIELD

Embodiments are generally related to NOx burners and in particular to ultra-low NOx industrial burners used with process heaters and industrial boilers.

Embodiments also relate to a refractory and refractory block used in NOx burners.

BACKGROUND

NOx oxides of nitrogen in the form of nitrogen oxide (NO) and nitrogen dioxide ($NO_2$) (oxides of nitrogen can generally be referred to as: NOx) are generated by the burning of fossil fuels. Along with NOx from vehicles, NOx from fossil fuel fired industrial and commercial heating equipment (e.g., furnaces, ovens, etc.) is a major contributor to poor air quality, smog and depletion of ozone layer.

In industrial burners, the air from a blower or process air is mixed with fuel (natural gas or propane or any type of gaseous fuel or liquid fuel) to produce heat. When fuel is burnt, NOx is formed due to the presence of nitrogen and oxygen in air.

Present-day industrial burners used in the process industry can achieve, for example, <30 ppm NOx with external flue gas recirculation (EFGR) at 15% excess air in the exhaust. Numerous studies have shown that adding flue gas to the air can cut down NOx significantly. When flue gas is added to the air, the overall concentrations of nitrogen and oxygen can be reduced in the air-flue gas mixture (as flue gas contains predominantly CO2 and H2O). Furthermore, due to the high heat capacities of CO2 and H2O, the flame temperature reduces, thereby leading to a lower flame temperature. This lower flame temperature can reduce NOx.

EFGR requires exhaust gas piped back from the exhaust stack to the combustion air intake where it can enter the blower to be mixed with the combustion air. This method requires additional piping, maintenance and apparatus around the burner and boiler (or another fired chamber). This approach also requires an enlargement or up-sizing of the combustion air fan to handle the increased volume of the added flue gas.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

It is, therefore, one aspect of the embodiments to provide for an improved burner.

It is another aspect of the embodiments to provide for an improved NOx burner.

It is a further aspect of the embodiments to provide for an ultra-low NOx industrial burner for use with process heaters and industrial boilers that produce NOx of <25 ppm without external flue gas recirculation (EFGR).

It is an additional aspect of the embodiments to provide for a flame stabilization apparatus that includes a group of spokes that stabilizes a flame over a range of operations of the burner.

It is a further aspect of the embodiments to provide for a torpedo type flame stabilization apparatus with fuel injection upstream of a torpedo.

The aforementioned aspects and other objectives can now be achieved as described herein. In an embodiment, a flame stabilization apparatus with fuel injection upstream of a torpedo, can include a flame stabilization plate that comprises a plurality of spokes that stabilizes a flame over a range of operations of a burner, wherein the plurality of spokes surrounds a fuel plenum; a first group of fuel ports located in a fuel tube upstream of the torpedo and a second group of fuel ports located in the flame stabilization plate; and a discharge cone comprising a discharge zone for the burner, wherein the flame with respect to the flue gas is stabilized at an end of the burner in the discharge zone.

In an embodiment, the burner can comprise a refractory block, the refractory block including a plurality of flue gas ports, wherein a flue gas is pulled into the burner from the plurality of flue gas ports.

In an embodiment, the burner can include a mixing zone, wherein the flue gas mixes with air in the mixing zone.

In an embodiment, the torpedo can include a diverging conical section that reduces an area of a mixing zone of the burner and allows the flue gas and the air to interact.

In an embodiment, the discharge cone can include the diverging conical section.

In an embodiment, the torpedo can achieve stability with respect to the flame with NOx levels of less than 25 ppm.

In an embodiment, the torpedo can achieve stability with respect to the flame with a turn-down rate of 10:1 or higher.

In an embodiment, a method of operating a flame stabilization apparatus with fuel injection upstream of a torpedo, can involve: injecting fuel into an air stream at an entrance to the torpedo from a fuel tube of a burner; and stabilizing a flame with a flame stabilization plate that includes a plurality of spokes surrounding a fuel plenum, wherein a first group of fuel ports is located in the fuel tube upstream of the torpedo and a second group of fuel ports is located in the flame stabilization plate, and the flame with respect to the flue gas is stabilized at an end of the burner in a discharge zone of a discharge cone.

In an embodiment, a flame stabilization apparatus can include a flame stabilization plate that comprises a plurality of spokes that stabilizes a flame over a range of operations of a burner, and a discharge cone comprising a discharge zone for the burner, wherein a flame with respect to the flue gas is stabilized at an end of the burner in the discharge zone.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the detailed description of the invention, serve to explain the principles of the present invention.

Identical or similar parts or elements in the figures are indicated by the same reference numerals.

DETAILED DESCRIPTION

Figure 1:
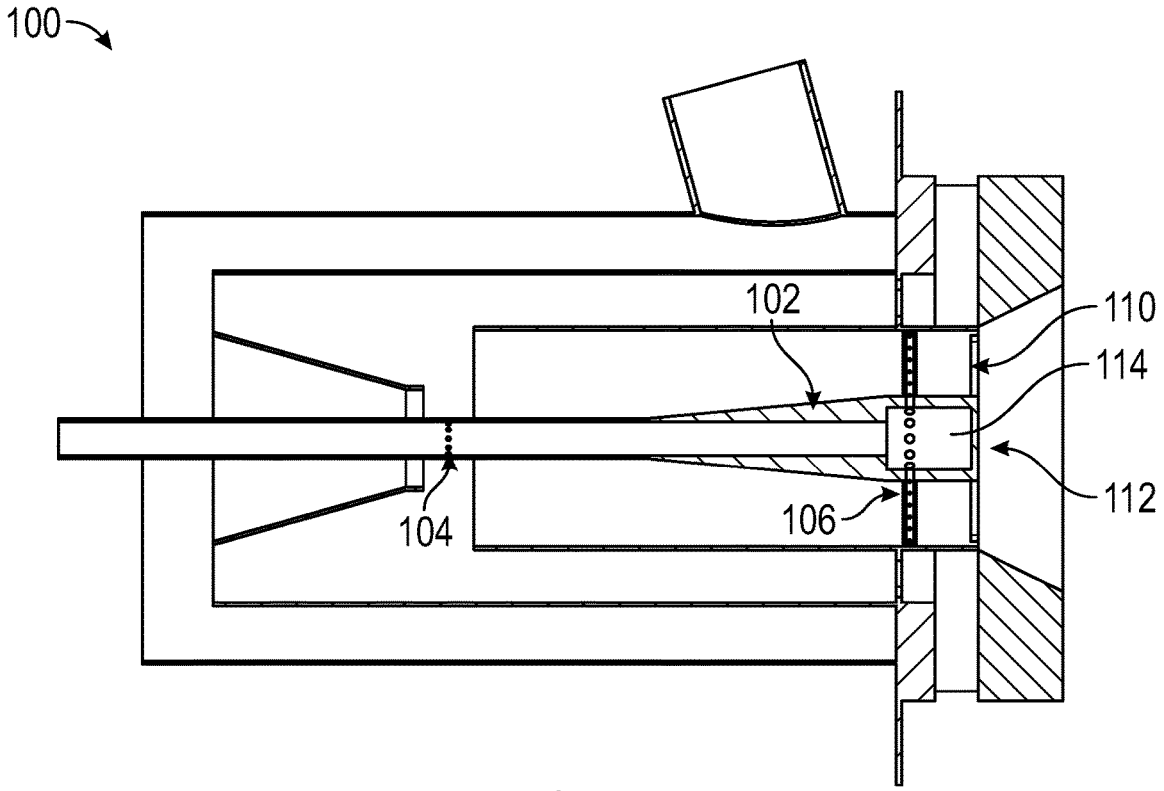
FIG. 1 illustrates a sectional view of a burner with a torpedo, in accordance with an embodiment.

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in an embodiment" or "in one embodiment" or "in an example embodiment" and variations thereof as utilized herein may or may not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. Furthermore, the term "at least one" as used herein, may refer to "one or more." For example, "at least one widget" may refer to "one or more widgets."

In addition, the term "based on" may be understood as not necessarily intended to convey an exclusive set of factors and may, instead, allow for existence of additional factors not necessarily expressly described, again, depending at least in part on context.

FIG. 1 illustrates a top view of a burner 100 with a torpedo 102, in accordance with an embodiment. Note that the term "torpedo" as utilized herein can relate to a torpedo-shaped component of the burner 100 and can include a torpedo assembly and/or a torpedo device. As will be discussed in greater detail herein, a torpedo type flame stabilization apparatus with fuel injection upstream of the torpedo 102 can be implemented with the burner 100.

The burner 100 can be implemented as an ultra-low NOx (ULE) burner that operates with Internal Flue Gas Recirculation (IFGR). FIG. 1 depicts the major components of the burner 100, including a plurality of fuel injections ports 104, 106, and 112. The fuel injection port 104 comprises a first stage fuel injection port, while the fuel injection port 106 and the fuel injection port 112 respectively comprise second and third stage fuel injection ports. The torpedo 102 additionally may include a group of stabilization spokes 110.

In this burner design, flue gas is pulled into the burner with a jet pump that acts like a suction pump. The flue gas can be pulled into the burner 100 from flue gas ports that are incorporated into a refractory block and a burner flange. The flue gas mixes with the air stream in a mixing zone. The flame is stabilized at the end of the burner 100 in a discharge cone of the refractory block.

The burner 100 can manage and optimize fuel and air mixing, which can occur inside, for example, the burner 100 and/or other devices such as a boiler. As the process is optimized, a large and much more balanced flame can be created, which can reduce the peak temperature and therefore a minimal amount of NOx may be produced.

In the Ultra-Low NOx (ULE) burner design of the burner 100, less than 25 ppm NOx can be achieved. As discussed previously, whether IFGR or EFGR, adding flue gas to the air stream creates flame stability issues even though low NOx can be achieved. Furthermore, flame visibility may also be reduced. In order for the IFGR technology of the embodiments to function properly, three key issues need to be addressed. These are 1) mixing of the flue gas with the incoming airstream, 2) rapid fuel-air mixing and 3) achieving a stable flame over the range of operation of the burner 100. This requires a careful design of internal components to achieve a stable visible flame with the desired NOx levels of less than 25 ppm with increased turn-down ratio of 10:1 or higher. This can be achieved through the use of the torpedo 102.

Figure 2:
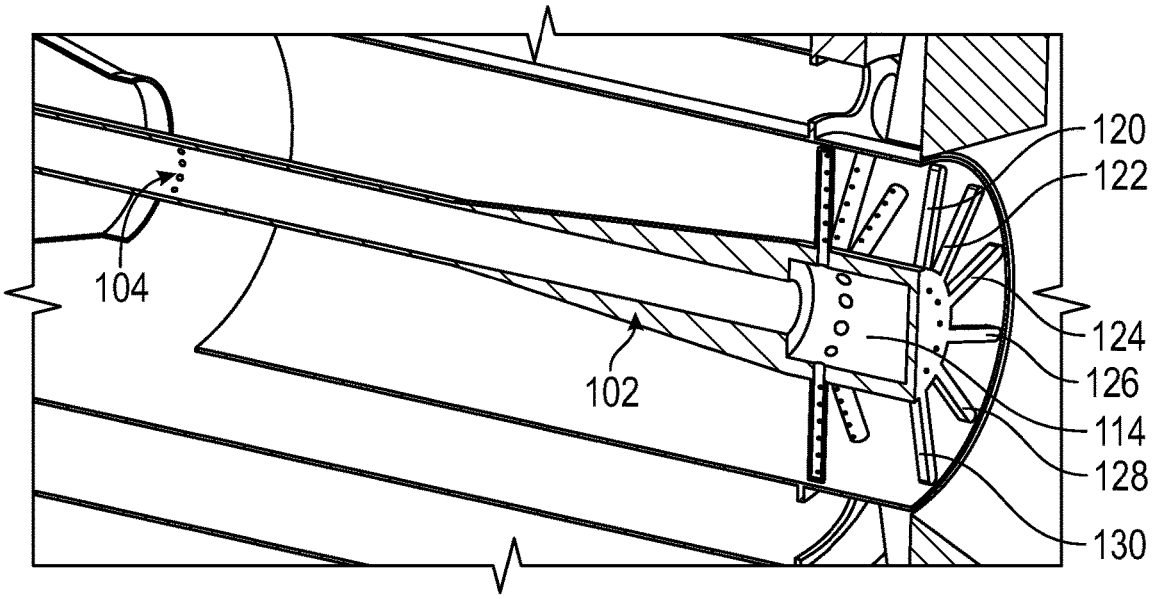
FIG. 2 illustrates side perspective sectional view of the torpedo depicted in FIG. 1, in accordance with an embodiment.

FIG. 2 illustrates side perspective sectional view of the torpedo 102 depicted in FIG. 1, in accordance with an embodiment. FIG. 2 depicts the ULE burner design of the burner 100 with the flow path of flue gas recirculation and the role of the torpedo assembly (i.e., the assembled torpedo 102). The torpedo is a key component in the ULE burner 100. The torpedo solves the aforementioned three issues which including 1) the need to serve as a mixing device for flue gas with air, 2) the need to also serves as device for fuel injection at three locations for rapid mixing of fuel and air, and 3) the need for a unique flame stabilization plate with the stabilization spokes 110 that serve to stabilize the flame over the range of burner operation. The stabilization spokes 110 can include a plurality of stabilization spokes 120, 122, 124, 126, 128, 130, etc., as shown in FIG. 2.

Figure 3:
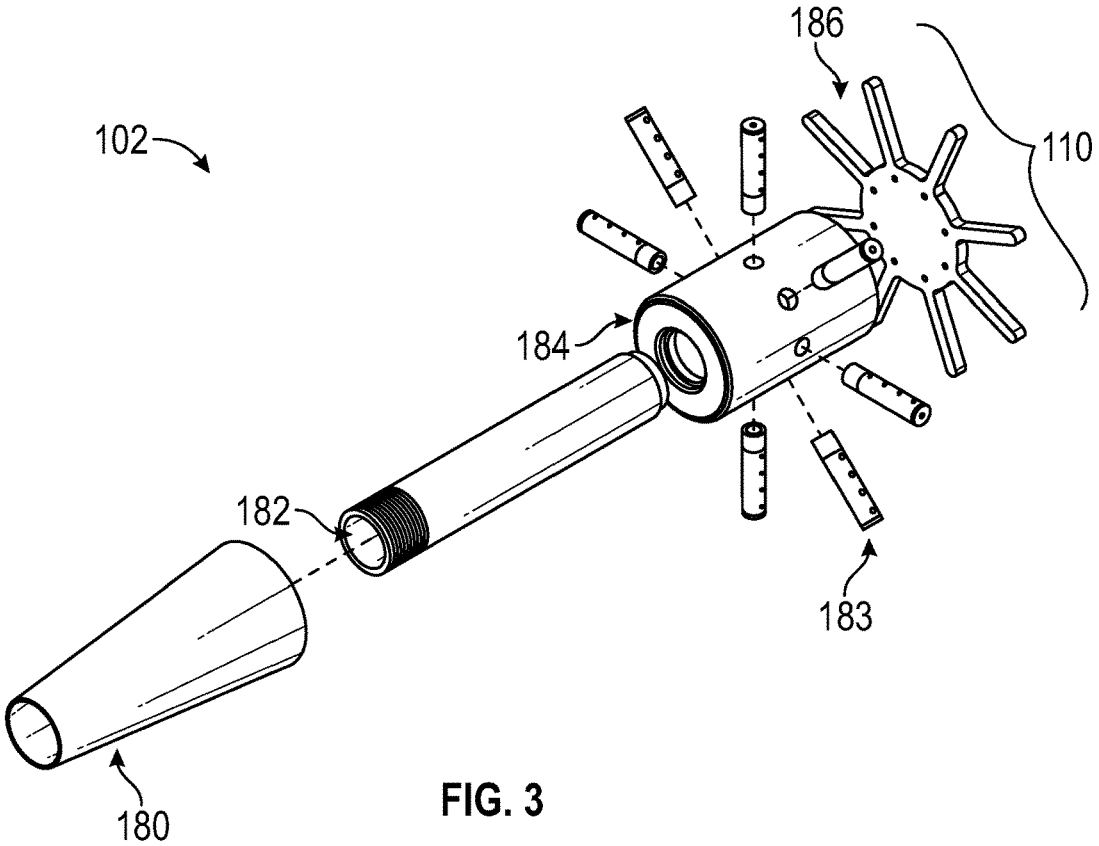
FIG. 3 illustrates an exploded view of the torpedo shown in FIG. 1 and FIG. 2 in accordance with an embodiment.

FIG. 3 illustrates an exploded view of the torpedo 102 shown in FIG. 1 and FIG. 2, in accordance with an embodiment. The torpedo 102 can function as a flame stabilization apparatus. FIG. 3 depicts the details of the design of the torpedo 102. The torpedo 102 can include a discharge cone 180 which can be configured with a diverging conical section that can reduce the area of the mixing zone within the burner 100. This feature can enable the flue gas and air to interact. The discharge cone 180 can include a discharge zone for the burner, wherein the flame with respect to the flue gas is stabilized at an end of the burner in the discharge zone.

The torpedo 102 further includes a fuel supply pipe 182 that connects to the discharge cone 180 (also referred to as a 'rolled' cone) and to a fuel plenum tube 184 (also referred to simply as a fuel tube). The discharge cone 180 surrounds the fuel supply pipe 182 when the torpedo 102 is assembled.

The fuel is injected into the air stream at the entrance of the torpedo section from the fuel tube. This can achieve a premixed fuel and air (e.g., 10-15%) of the fuel, which can be injected in the stage1 holes (i.e., fuel injections ports 104). At the end of the diverging conical section (i.e., discharge cone 180), the flow is straightened with a straight section comprising the fuel supply pipe 182 and then the fuel plenum tube 184.

The fuel plenum tube 184 can house a series of fuel spokes 183 around a cylindrical block the forms the fuel plenum tube 184. Fuel can be injected through the spokes 183. The fuel spokes 183 have a series or group of fuel ports that can inject fuel into the air stream. These fuel spokes with the holes can rapidly mix the fuel with the air and the flue gas. In some embodiments, 50-70% of the fuel can be injected through these holes.

The fuel can be injected along the flow direction of air or at 90 deg to the flow direction of air. A flame stabilization plate 186 can be connected (e.g., welded) at the end of the last straight section comprising the fuel plenum tube 184. The flame stabilization plate 186 can include a series or group of flame stabilization spokes 110 and a group of fuel ports 112 that can inject, for example, around 2-10% of the fuel. The gap between the fuel spokes and flame stabilization spokes can be designed to achieve partial or fully premixing of fuel, air and flue gas. In some embodiments, a stable flame with a high turndown ratio of 10:1 may be produced.

An embodiment may be configured from rolled and formed sheet metal, tubing, pipe or other suitable material which may be used in burners. For example, as shown in FIG. 3, the torpedo 102 includes the fuel plenum tube 184, which can be configured as a stainless-steel round bar, which can be drilled through to create the fuel plenum tube 184. Along the circumference of the fuel plenum tube 184, eight or ten or a higher number of fuel spokes 183 can be screwed into the fuel plenum tube 184. The fuel spokes 183 can be configured, for example, from standard pipe material. Each fuel spoke may have eight or ten fuel ports drilled through. The number of spokes and the number of fuel ports can be based on the size of the burner 100.

At the inlet of the fuel plenum tube 184, the fuel supply pipe 182 can be welded, which can supply the gaseous fuel. Around the fuel supply pipe 182, a rolled sheet of metal in a conical shape (i.e., see cone 180) can be welded to the fuel plenum tube 184 and the fuel supply pipe 182. The angle of the cone 180 can be based on the fuel pipe diameter and plenum tube diameter. These parameters may be specific to the size of the burner 100.

The flame stabilization plate 186 can be welded to the other end of the fuel plenum tube 184. The torpedo 102 can be used in, for example, ULE-Burner devices. The burner sizes may range from, for example, 2.5 MMBTU/hr to 50 MMBTU/hr. Each burner may include a torpedo design installed for flame stabilization. This component of the burner 100 can be critical for the functioning of the burner 100. In some embodiments, the burner 100 can be installed in indirect fired systems such as process heaters and boilers.

Figure 4:
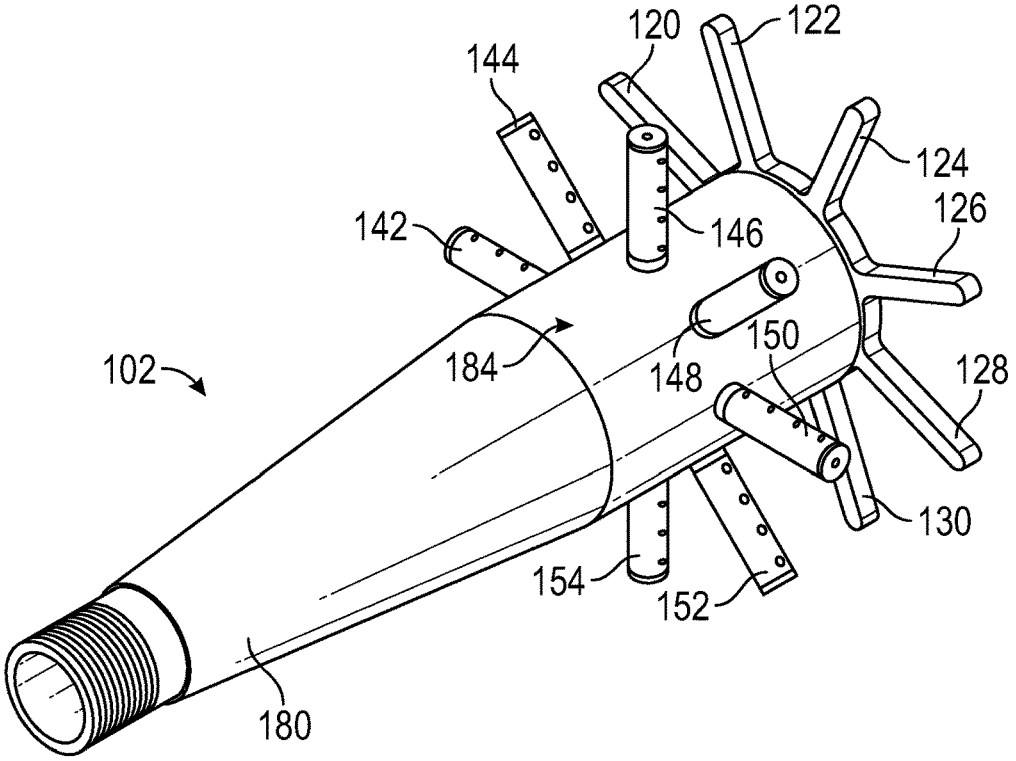
FIG. 4 illustrates a perspective view of the torpedo as assembled, in accordance with an embodiment.

FIG. 4 illustrates a perspective view of the torpedo 102 as assembled (i.e., the torpedo assembly), in accordance with an embodiment. The discharge cone 180 is shown connected to the fuel plenum tube 184. The fuel supply pipe 182 does not appear in FIG. 4, but it can be appreciated that the fuel supply pipe 182 is located within the discharge cone 180. Examples of the fuel spokes 183 can include, for example, the fuel spokes 142, 144, 148, 150, 152, and 154 shown in FIG. 4. Examples of the stabilization spokes include the stabilization spokes 120, 122, 124, 126, 128, 130, etc.

The burner 100 can be implemented with systems and devices such as, for example, indirect fired process heaters and boilers. The torpedo design of the burner 100 is an important feature of the burner 100, which can solve the three previously discussed issues of a) mixing of flue gas with air b) fuel-air mixing, and c) flame stabilization. A result of this design has produced NOx of ~15 ppm meeting the 25 ppm NOx requirements from indirect fired burners and a turn-down ratio of 10:1. With this design, the fuel can be injected in three different locations (e.g., see Stage 1, Stage 2 and Stage 3 fuel injection sites in FIG. 1) for rapid fuel-air mixing and flame stabilization. This design is a unique nozzle mix design without the necessity of fully premixing of fuel and air and still achieving lower NOx levels than premixed design. This design eliminates flash-backs which are common occurrence for premixed burners. This design can also be scaled to larger burner sizes.

Figure 5:
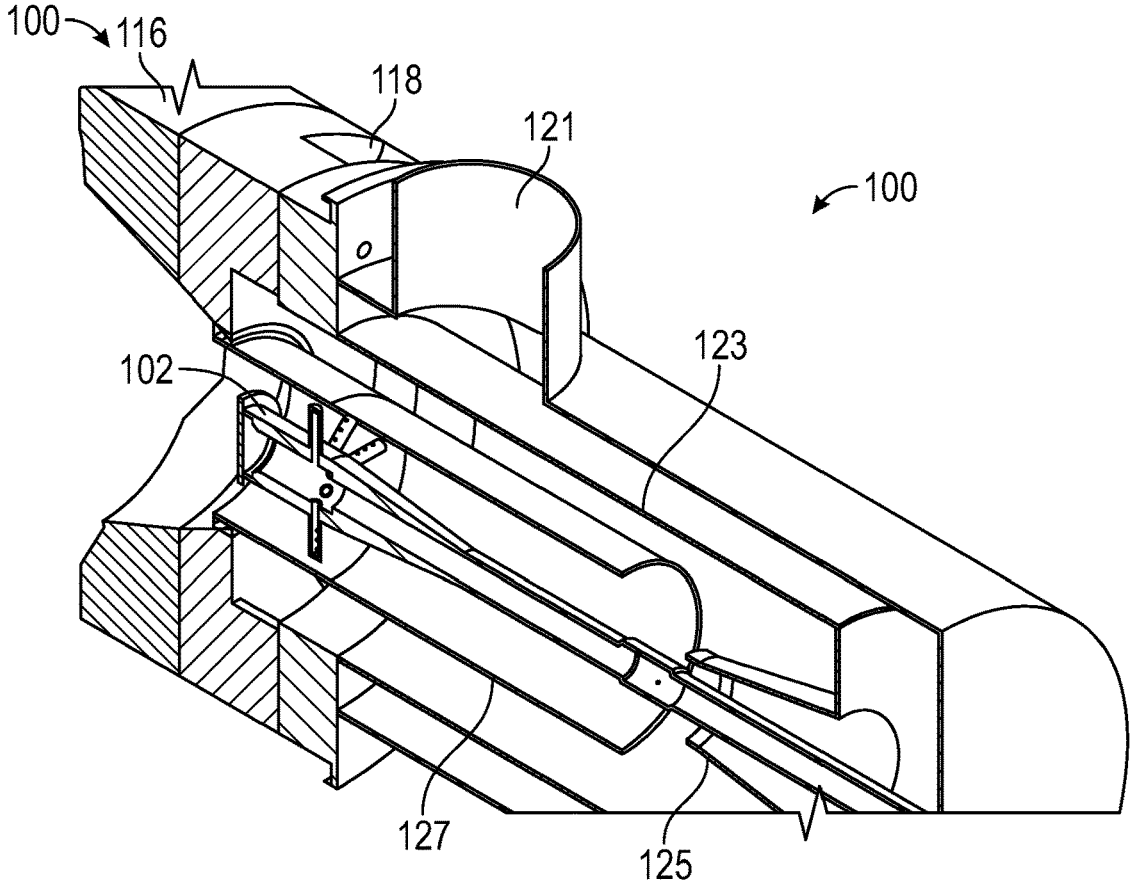
FIG. 5 illustrates a perspective view of a burner apparatus including a refractory block and torpedo assembly, in accordance with an embodiment.

FIG. 5 illustrates a perspective view of the burner 100 including a refractory block 116 and the previously described torpedo assembly 102, in accordance with an embodiment. FIG. 5 is presented to indicate that the torpedo assembly 102 can be adapted for use with a burner such as the burner 100. The burner 100 can include a combustion air inlet 121 and one or more FGR inlet ports such as FGR inlet port 118. The burner 100 can be additionally configured with an FGR tube 123, a jet pump 125, and a mixing tube 127.

Figure 6:
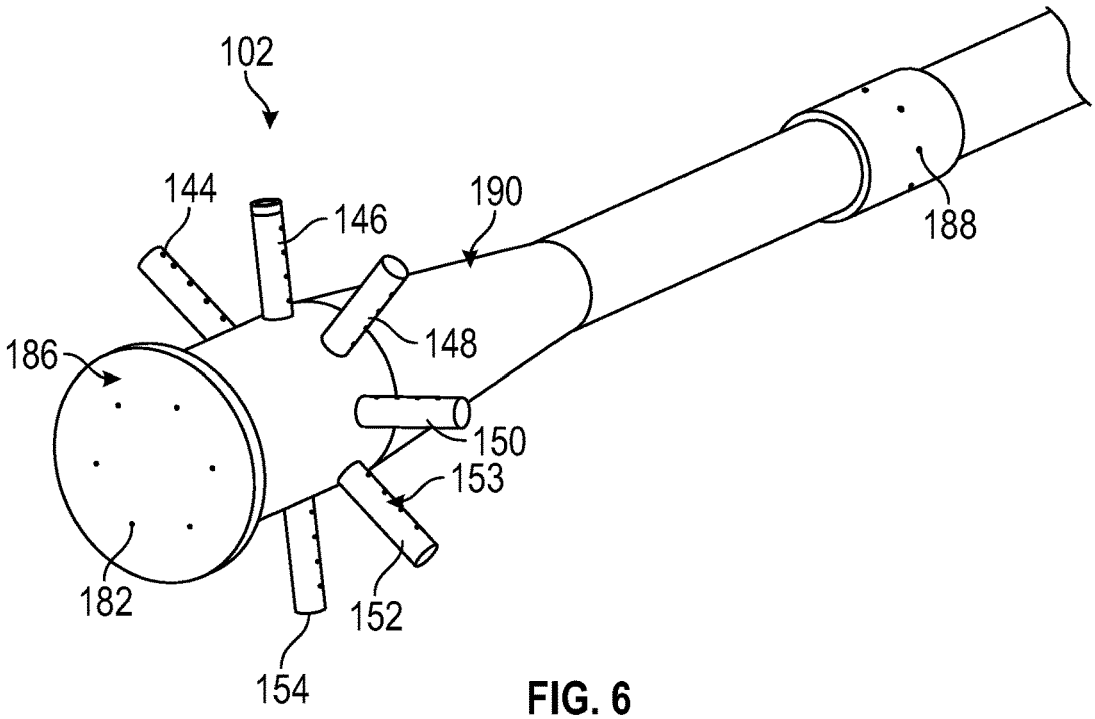
FIG. 6 illustrates a perspective view of a torpedo, in accordance with an embodiment.

FIG. 6 illustrates a perspective view of the torpedo 102, in accordance with an embodiment. As discussed previously, the torpedo 102 can include a group of fuel spokes 144, 146, 148, 150, 152, 154, and so on. These fuel spokes 144, 146, 148, 150, 152, 154, etc., can function as primary spokes. Each of these primary fuel spokes can be configured with one or more primary fuel ports, such as the primary fuel port 153 associated with the primary spoke 152, and so on. The torpedo 102 includes the fuel stabilization plate 186 which is configured with one or more flame stabilization fuel ports such as the flame stabilization fuel port 192 shown in FIG. 6.

Figure 7:
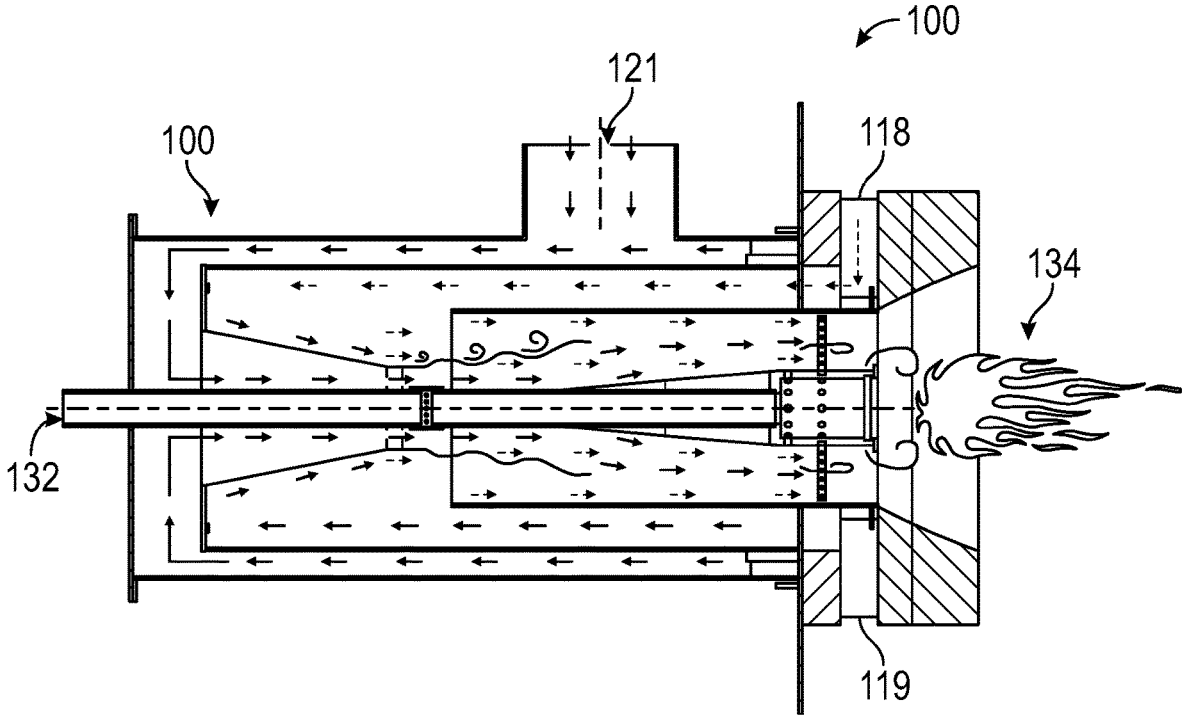
FIG. 7 illustrates a sectional view of a burner including a combustion air inlet, a fuel inlet and FGR inlet port(s), in accordance with an embodiment.

FIG. 7 illustrates a sectional view of the burner 100 including the combustion air inlet 121, a fuel inlet 132 and FGR inlet ports 118 and 119, in accordance with an embodiment. FIG. 7 depicts the burner 100 in operation with the flame 134 subject to the flame stabilization process described above.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A flame stabilization apparatus with fuel injection upstream of a torpedo, comprising:

a flame stabilization plate that includes a plurality of spokes that stabilizes a flame over a range of operations of a burner, wherein the plurality of spokes surrounds a fuel plenum;

a first group of fuel ports located in a fuel tube upstream of the torpedo and a second group of fuel ports located in the flame stabilization plate; and a discharge cone comprising a discharge zone for the burner, wherein the flame with respect to the flue gas is stabilized at an end of the burner in the discharge zone, wherein the torpedo comprises a diverging conical section that reduces an area of a mixing zone of the burner and allows the flue gas and the air to interact.

2. The flame stabilization apparatus of claim 1 wherein the burner comprises a refractory block, the refractory block including a plurality of flue gas ports, wherein a flue gas is pulled into the burner from the plurality of flue gas ports.

3. The flame stabilization apparatus of claim 1 wherein the burner includes a mixing zone, wherein the flue gas mixes with air in the mixing zone.

4. The flame stabilization apparatus of claim 1 wherein the torpedo comprises a fuel supply pipe that connects to the discharge cone and to a fuel plenum tube, wherein the discharge cone surrounds the fuel supply pipe .

5. The flame stabilization apparatus of claim 1, wherein the discharge cone includes the diverging conical section.

6. The flame stabilization apparatus of claim 1 wherein the torpedo achieves stability with respect to the flame with NOx levels of less than 25 ppm.

7. The flame stabilization apparatus of claim 1 wherein the torpedo achieves stability with respect to the flame with a turn-down rate of 10:1 or higher.

8. A method of operating a flame stabilization apparatus with fuel injection upstream of a torpedo, comprising:

injecting fuel into an air stream at an entrance to the torpedo from a fuel tube of a burner; and stabilizing a flame with a flame stabilization plate that includes a plurality of spokes surrounding a fuel plenum, wherein a first group of fuel ports is located in the fuel tube upstream of the torpedo and a second group of fuel ports is located in the flame stabilization plate, and the flame with respect to the flue gas is stabilized at an end of the burner in a discharge zone of a discharge cone, wherein the torpedo comprises a diverging conical section that reduces an area of a mixing zone of the burner and allows the flue gas and the air to interact.

9. The method of claim 8 wherein the burner comprises a refractory block, the refractory block including a plurality of flue gas ports, wherein a flue gas is pulled into the burner from the plurality of flue gas ports.

10. The method of claim 8 wherein the burner includes a mixing zone, wherein the flue gas mixes with air in the mixing zone.

11. The method of claim 8 wherein the torpedo comprises a fuel supply pipe that connects to the discharge cone and to a fuel plenum tube, wherein the discharge cone surrounds the fuel supply pipe.

12. The method of claim 8, wherein the discharge cone includes the diverging conical section.

13. The method of claim 8, wherein the torpedo achieves stability with respect to the flame with NOx levels of less than 25 ppm.

14. The method of claim 8, wherein the torpedo achieves stability with respect to the flame with a turn-down rate of 10:1 or higher.

15. A flame stabilization apparatus, comprising:

a flame stabilization plate that includes a plurality of spokes that stabilizes a flame over a range of operations of a burner; and a discharge cone comprising a discharge zone for the burner, wherein a flame with respect to the flue gas is stabilized at an end of the burner in the discharge zone; and a torpedo that includes a diverging conical section that reduces an area of a mixing zone of the burner and allows the flue gas and the air to interact, the discharge cone including the diverging conical section.

16. The flame stabilization apparatus of claim 15 wherein the burner comprises a refractory block connected to the flame stabilization plate, the refractory block including a plurality of flue gas ports, wherein a flue gas is pulled into the burner from the plurality of flue gas ports.

17. The flame stabilization apparatus of claim 15 wherein the burner includes a mixing zone, wherein the flue gas mixes with air in the mixing zone.

18. The flame stabilization apparatus of claim 15 comprises a fuel supply pipe that connects to the discharge cone and to a fuel plenum tube, wherein the discharge cone surrounds the fuel supply pipe.

19. The flame stabilization apparatus of claim 18 wherein the torpedo achieves stability with respect to the flame with NOx levels of less than 25 ppm.

20. The flame stabilization apparatus of claim 18 wherein the torpedo achieves stability with respect to the flame with a turn-down rate of 10:1 or higher.

* * * * *